US005515058A

United States Patent [19]

Chaney et al.

[11] Patent Number: 5,515,058

[45] Date of Patent: May 7, 1996

[54] ANTENNA ALIGNMENT APPARATUS AND METHOD UTILIZING THE ERROR CONDITION OF THE RECEIVED SIGNAL

[75] Inventors: John W. Chaney, Indianapolis; John J. Curtis, III, Noblesville; David E. Virag, Indianapolis, all of Ind.

[73] Assignee: Thomson Consumer Electronics, Inc., Indianapolis, Ind.

[21] Appl. No.: 257,272

[22] Filed: Jun. 9, 1994

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,352,202 | 9/1982 | Carney . | |
| 4,796,032 | 1/1989 | Sakurai et al. | 342/359 |
| 4,888,592 | 12/1989 | Paik et al. | 342/359 |
| 4,893,288 | 1/1990 | Maier et al. | 367/116 |
| 5,287,115 | 2/1994 | Walker et al. | 342/359 |
| 5,300,935 | 4/1994 | Yu | 342/359 |
| 5,376,941 | 12/1994 | Fukazawa et al. | 342/359 |

*Primary Examiner*—Theodore M. Blum

*Attorney, Agent, or Firm*—Joseph S. Tripoli; Peter M. Emanuel

[57] ABSTRACT

A satellite receiver for digitally encoded television signals includes apparatus for aligning the receiving antenna which is responsive to the number of errors contained in the digitally encoded television signals. Error correction is possible if the number of errors is below a threshold and not possible if the number of errors is above the threshold. The elevation of the antenna is set according to the location of the receiving site. Thereafter, the azimuth of the antenna is coarsely aligned by first rotating the antenna in small increments to locate a region in which error correction is possible. During this coarse alignment procedure, the tuner of the satellite receiver attempts to locate a tuning frequency at which and demodulation and error correction is possible. If no appropriate frequency is found after a range of frequencies have been searched, the antenna is rotated by a small increment. Once error correction is found to be possible, a fine alignment procedure is initiated in which the antenna is rotated to locate boundaries of an azimuth arc through which error correction is continuously possible. Thereafter, the antenna is set so that it is at least approximately midway between the two boundaries of the arc.

7 Claims, 6 Drawing Sheets

ANTENNA ALIGNMENT APPARATUS AND METHOD UTILIZING THE ERROR CONDITION OF THE RECEIVED SIGNAL

CROSS REFERENCE TO A RELATED APPLICATION

The present application is related to U.S. application Ser. No. 08/257,650 entitled "Apparatus and Method for Aligning a Receiving Antenna Utilizing an Audible Tone" filed concurrently with the present application and in the name of the same inventors.

1. Field of the Invention

The present invention concern an apparatus and a method for aligning an antenna such as a satellite receiving antenna.

2. Background of the Invention

A receiving antenna should be aligned with respect to the source of transmitted signals for optimal signal reception. For example, in the case of a satellite television system, this means accurately pointing the axis of a dish-like antenna so that an optimal picture is displayed on the screen of an associated television receiver.

The antenna alignment procedure may be facilitated by the use of apparatus which measures a parameter of the signal received by the antenna and which produces a signal indicating the magnitude of the parameter as the antenna is moved. For example, the antenna alignment may be facilitated by the use of a signal strength meter or other test instrument which is temporarily connected to the receiving antenna for measuring the amplitude of the received signal directly at the antenna.

It is also known to provide parameter measuring apparatus within the receiver itself to eliminate the need for additional test equipment. The parameter indicating signal may be used to produce a visible or audible response which is monitored by the user as the antenna is manually moved. The antenna is considered to be aligned when a characteristic of the response, such as the length of a displayed bar or frequency of an audible tone, has a maximum or minimum value depending on the nature of the measured parameter. For example, U.S. Pat. No. 4,893,288, entitled "Audible Antenna Alignment Apparatus" issued to Gerhard Maier and Veit Ambruster on Jan. 9, 1990, discloses an apparatus for adjusting a satellite receiving antenna which produces an audible response having a frequency which is inversely related to the amplitude of the IF signal derived from the received signal. The frequency of the audible response is high when the antenna is misaligned and the amplitude of the IF signal is low. The frequency of the audible response decreases as the antenna is brought into alignment and the amplitude of the IF signal increases.

Parameters other than signal strength may be monitored. For example, U.S. Pat. No. 5,287,115 issued to Walker et al. concerns an antenna alignment apparatus for a satellite receiving antenna which receives signals having information encoded in digital form and which monitors the bit error rate (BER) of the digitally encoded information. The antenna is moved from an initial position until the BER parameter is minimized. The Walker antenna alignment apparatus is an automatic one which uses a motor to move the antenna.

The antenna alignment apparatus of the type described above require a judgment of when a parameter has a minimum or maximum value in order to align the antenna for optimal reception. In the case of a manual antenna alignment apparatus, a user may have difficulty in making such a judgment. In the case of an automatic antenna alignment apparatus, a relatively complicated antenna alignment algorithm may be required to avoid judgment errors.

SUMMARY OF THE INVENTION

The present invention concerns antenna alignment apparatus and associated method which dogs not require a determination of whether a measured parameter has a maximum or minimum value. Instead, the invention relies on a determination of whether or not the measured parameter indicates acceptable reception, and a determination of the range of antenna positions over which the measured parameter indicates acceptable reception. Once the range is determined, the antenna is set midway in the range resulting in optimal or near optimal reception. The invention is particularly well suited for aligning an antenna in a system in which the transmitted signals contain at least some information which is encoded in digital form. In such a system, apparatus, according to an aspect of the invention, includes means for determining whether or not errors in the digitally encoded information are correctable, and means responsive to error condition determination for generating an antenna alignment indicating signal having a first state when error correction is possible and a second state when error correction is not possible. In an associated method, according to another aspect of the invention, includes the initial step of monitoring the error condition responsive antenna alignment indicating signal as the antenna is moved to determine when transitions occur between said first and second states and thereby the boundaries of a range of antenna positions over which error correction is possible. Thereafter, the antenna is moved so that it is positioned midway between the boundaries.

These and other aspects of the invention will be described with reference to the accompanying Drawing.

BRIEF DESCRIPTION OF THE DRAWING

In the Drawing.

In the various Figures, the same or similar elements shown are identified by the same reference numbers.

DETAILED DESCRIPTION OF THE DRAWING

Figures 1, 1A:
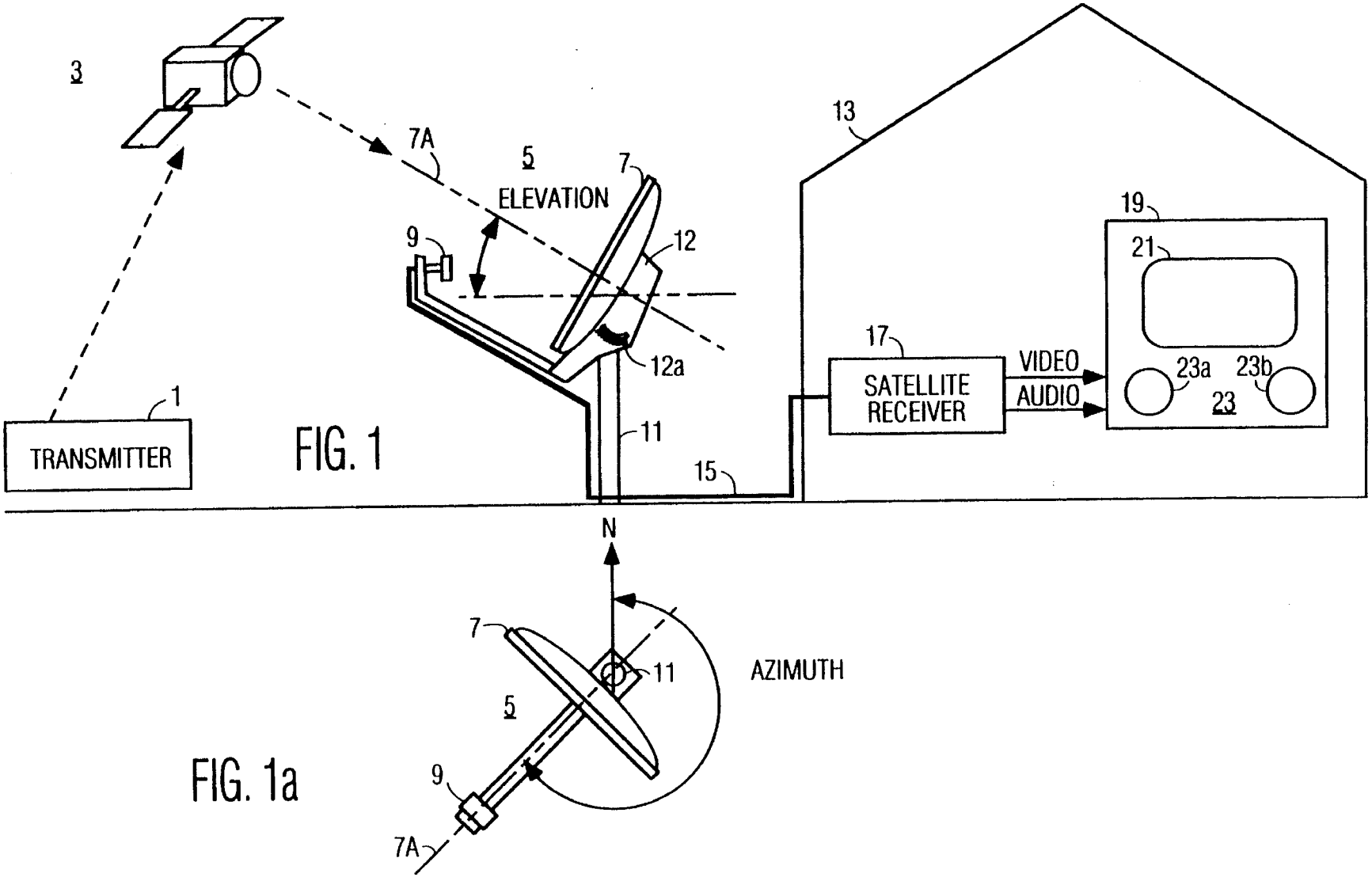
FIG. 1 is a schematic diagram of the mechanical arrangement of a satellite television receiving system.
FIG. 1*a* is a plan view of the antenna assembly shown in FIG. 1.

In the satellite television system shown in FIG. 1, a transmitter 1 transmits television signals including video and audio components to a satellite 3 in geosynchronous earth orbit. Satellite 3 receives the television signals transmitted by transmitter 1 and retransmits them toward the earth.

Satellite 3 has a number, for example, 24, of transponders for receiving and transmitting television information. The invention will be described by way of example with respect to a digital satellite television system in which television information is transmitted in compressed form in accordance with a predetermined digital compression standard such as MPEG. MPEG is an international standard for the coded representation of moving pictures and associated audio information developed by the Motion Pictures Expert Group. The digital information is modulated on a carrier in what is known in the digital transmission field as QPSK (Quaternary Phase Shift Keying) modulation. Each transponder transmits at a respective carrier frequency and with either a high or low digital data rate.

The television signals transmitted by satellite 3 are received by an antenna assembly or "outdoor unit" 5. Antenna assembly 5 includes a dish-like antenna 7 and a frequency converter 9. Antenna 7 focuses the television signals transmitted from satellite 3 to the frequency converter 9 which converts the frequencies of all the received television signals to respective lower frequencies. Frequency converter 9 is called a "block converter" since the frequency band of all of the received television signals is converted as a block. Antenna assembly 5 is mounted on a pole 11 by means of an adjustable mounting fixture 12. Although pole 11 is shown at some distance from a house 13, it may actually be attached to house 13.

The television signals produced by block converter 7 are coupled via a coaxial cable 15 to a satellite receiver 17 located within house 13. Satellite receiver 17 is sometimes referred to as the "indoor unit". Satellite receiver 17 tunes, demodulates and otherwise processes the received television signal as will be described in detail with respect to FIG. 3 to produce video and audio signals with a format (NTSC, PAL or SECAM) suitable for processing by a conventional television receiver 19 to which they are coupled. Television receiver 19 produces an image on a display screen 21 in response to the video signal. A speaker system 23 produces an audible response in response to the audio signal. Although only a signal audio channel is indicated in FIG. 1, it will be understood that in practice one or more additional audio channels, for example, for stereophonic reproduction, may be provided as is indicated by speakers 23*a* and 23*b*. Speakers 23*a* and 23*b* may be incorporated within television receiver 19, as shown, or may be separate from television receiver 19.

Dish antenna 7 has to be positioned to receive the television signals transmitted by satellite 3 to provide optimal image and audible responses. Satellite 3 is in geosynchronous earth orbit over a particular location on earth. The positioning operation involves accurately aligning center line axis 7A of dish antenna to point at satellite 3. Both an "elevation" adjustment and an "azimuth" adjustment are required for this purpose. As is indicated in FIG. 1, the elevation of antenna 7 is the angle of axis 7A relative to the horizon in a vertical plane. As is indicated in FIG. 1*a*, the azimuth is the angle of axis 7A relative to the direction of true north in a horizontal plane. Mounting fixture 12 is adjustable in both elevation and azimuth for the purpose of aligning antenna 7.

When the antenna assembly 5 is installed, the elevation can be adjusted with sufficient accuracy by setting the elevation angle by means of a protractor portion 12*a* of mounting fixture 12 according to the latitude of the receiving location. Once the elevation has been set, the azimuth is coarsely set by pointing antenna assembly generally in the direction of satellite 3 according to the longitude of the receiving location. A table indicating the elevation and azimuth angles for various latitudes and longitudes may be included in the owner's manual accompanying the satellite receiver 17. The elevation can be aligned relatively accurately using protractor 12*a* because pole 11 is readily set perpendicular to the horizon using a carpenter's level or plum line. However, the azimuth is more is more difficult to align accurately because the direction of true north cannot be readily determined.

Antenna alignment apparatus is included within satellite receiver 17 for purpose of simplifying the azimuth alignment procedure. The antenna alignment apparatus is responsive to the error condition of the received signal in accordance with the invention. The details of that apparatus will be described with reference to FIGS. 2 and 3. For the present, it is sufficient to understand that when the audible alignment apparatus is activated it will cause a continuous audible tone of fixed frequency and magnitude to be generated by speakers 23*a* and 23*b* only when the azimuth position is within a limited range, for example, of five degrees, in which correction of errors in the digitally encoded information of the received signal are possible. The continuous tone is no longer generated (that is it is muted) when the azimuth position is not within the limited range. The audible alignment apparatus will also cause a tone burst or beep to be produced each time a tuner/demodulator unit of satellite receiver 17 completes a search algorithm without finding a tuning frequency and data rate for a selected transponder at which correction of errors in the digitally encoded information of the received signal is possible. The search algorithm is need because although the carrier frequency for each transponder is known. block converter 9 has a tendency to introduce a frequency error, for example, in the order of several MHz, and the transmission data rate may not be known in advance.

A method for aligning the antenna for optimal or near optimal reception according to one aspect of the invention will now be described. Reference to the flow chart shown in FIG. 2, although primarily concerned with the operation of the electronic structure of satellite receiver 17 shown in FIG. 3, will be helpful during the following description.

An antenna alignment operation is initiated by the user, for example, by selecting a corresponding menu item from a menu which is caused to be displayed on the display screen 21 of television receiver 19 in response to the video signal generated by satellite receiver 17. Thereafter, the tuner/demodulator unit of satellite receiver 17 is caused to initiate the search algorithm for identifying the tuning the frequency and data rate of a particular transponder. During the search algorithm, tuning is attempted at a number of frequencies surrounding the nominal frequency for the selected transponder. Proper tuning is indicated when a "demodulator lock" signal produced by the tuner/demodulator, as will be described with reference to FIG. 3, has a "1" logic state. If tuning is proper, the error condition of the digitally encoded information contained in the received signal is examined at the two possible transmission data rates to determine whether or not error correction is possible. If either proper tuning or error correction is not possible at a particular search frequency, the tuning and error correction conditions are examined at the next search frequency. This process continues until all of the search frequencies have been evaluated. At that point, if either proper tuning or error correction was not possible at any of the search frequencies, a tone burst or beep is produced to indicate to a user that antenna 7 is not yet with the limited azimuth range needed for proper reception. On the other hand, if both proper tuning is achieved and error correction is possible at any of the search frequencies, the alignment apparatus causes a continuous tone to be produced to indicate to a user that the antenna 7 is within the limited azimuth range needed for proper reception.

The user is instructed in the operation manual accompanying satellite receiver 17 to rotate antenna assembly 5 around pole 11 by a small increment, for example, three degrees, when a beep occurs. Desirably, the user is instructed to rotate antenna assembly 5 once every other beep. This allows the completion of the tuning algorithm before antenna assembly 5 is moved again. (By way of example, a complete cycle of the tuning algorithm in which all search frequencies are searched may take three to five seconds.) The user is instructed to repetitively rotate antenna assembly 5 in the small (three degree) increment (once ever other beep) until a continuous tone is produced. The generation of the continuous tone denotes the end of a coarse adjustment portion of the alignment procedure and the beginning of a fine adjustment portion.

The user is instructed that once a continuous tone has been produced, to continue to rotate antenna assembly 5 until the continuous tone is again no longer produced (that is, until the tone is muted) and then to mark the respective antenna azimuth position as a first boundary position. The user is instructed to thereafter reverse the direction of rotation and to rotate antenna assembly 5 in the new direction past the first boundary. This causes the continuous tone to be generated again. The user is instructed to continue to rotate antenna assembly 5 until the continuous tone is again muted and to mark the respective antenna position as a second boundary position. The user is instructed that once the two boundary positions have been determined, to set the azimuth angle for optimal or near optimal reception by rotating antenna assembly 5 until it midway between the two boundary positions. The centering procedure has been found provide very satisfactory reception. The antenna alignment mode of operation is then terminated, for example, by leaving the antenna alignment menu displayed on screen 21 of television receiver 19.

The audible antenna alignment apparatus included within satellite receiver 17 which produces the audible tones employed in the alignment method described above will now be described with reference to FIG. 3.

Figure 3:
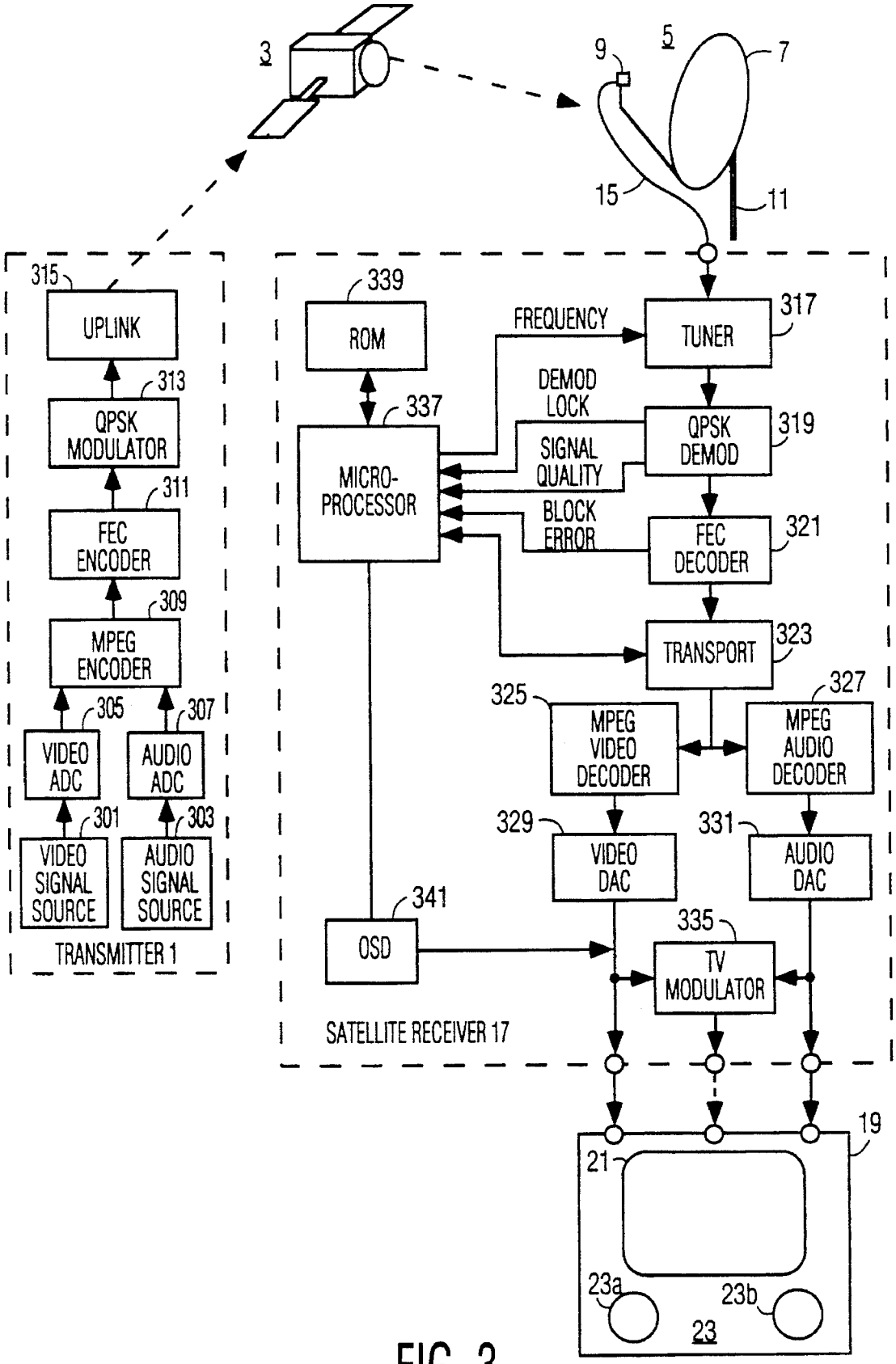
FIG. 3 is a block diagram of the electronic components of the satellite television system shown in FIG. 1 useful in understanding an apparatus for manually aligning the antenna assembly shown in FIGS. 1 and 1*a* in accordance with the present invention.

As shown in FIG. 3, transmitter 1 includes a source 301 of analog video signals and a source 303 of analog audio signals 303 and analog-to-digital converters (ADCs) 305 and 307 for converting the analog signals to respective digital signals. An encoder 309 compresses and encodes the digital video and audio signals according to a predetermined standard such as MPEG. The encoded signal has the form of a series or stream of packets corresponding to respective video or audio components. The type packet is identified by a header code. Packets corresponding to control and other data may also be added the data stream.

A forward error correction (FEC) encoder 311 adds correction data to the packets produced by encoder 309 in order make the correction of errors due to noise within the transmission path to satellite receive possible. The well known Viterbi and Reed-Solomon types of forward error correction coding may both be advantageously employed. A QPSK modulator 313 modulates a carrier with the output signal of FEC encoder 311. The modulated carrier is transmitted by a so called "uplink" unit 315 to satellite 3.

Satellite receiver 17 includes a tuner 317 with a local oscillator and mixer (not shown) for selecting the appropriate carrier signal form the plurality of signals received from antenna assembly 5 and for converting the frequency of the selected carrier to a lower frequency to produce an intermediate frequency (IF) signal. The IF signal is demodulated by a QPSK demodulator 319 to produce a demodulated digital signal. A FEC decoder 321 decodes the error correction data contained in the demodulated digital signal, and based on the error correction data corrects the demodulated packets representing video, audio and other information. For example, FEC decoder 321 may operate according to Viterbi and Reed-Solomon error correction algorithms where FEC encoder 311 of transmitter 1 employs Viterbi and Reed-Solomon error correction encoding. Tuner 317, QPSK demodulator 319 and FEC decoder may be includes in a unit available from Hughes Network Systems of Germantown, Md. or from Comstream Corp., San Diego, Calif.

A transport unit 323 is a demultiplexer which routes the video packets of the error corrected signal to a video decoder 325 and the audio packets to an audio decoder 327 via data bus according to the header information contained in the packets. Video decoder 325 decodes and decompresses the video packets and the resultant digital video signal is converted to a baseband analog video signal by a digital to analog converter (DAC) 329. Audio decoder 327 decodes and decompresses the audio packets and the resultant digital audio signal is converted to a baseband analog audio signal by a DAC 331. The baseband analog video and audio signals are coupled to television receiver via respective baseband connections. The baseband analog video and audio signals are also coupled to a modulator 335 which modulates the analog signal on to a carrier in accordance with a conventional television standard such as NTSC, PAL or SECAM for coupling to a television receiver without baseband inputs.

A microprocessor 337 provides local oscillator frequency selection control data to tuner 317 and receives a "demodulator lock" and "signal quality" data from demodulator 319 and a "block error" data from FEC decoder 321. Microprocessor 337 also operates interactively with transport 323 to affect the routing of data packets. A read only memory (ROM) 339 associated with microprocessor 335 is used is used to store control information. ROM 339 is also advantageously used to generate the tone and tone bursts described above for aligning antenna assembly 5, as will be described in detail below.

QPSK demodulator 319 includes a phase locked loop (not shown) for locking its operation to the frequency of the IF signal in order to demodulate the digital data with which the IF signal is modulated. As long as there is carrier which has been tuned, demodulator 319 can demodulate the IF signal independently of the number of errors which are contained in the digital data. Demodulator 319 generates a one bit "demodulator lock" signal, for example, having a "1" logic state, when its demodulation operation has been successfully completed. Demodulator 319 also generates a "signal quality" signal representing the signal-to-noise ratio of the received signal.

FEC decoder 321 can only correct a given number of errors per one block of data. For example FEC decoder 321 may only be able to correct eight byte errors within a packet of 146 bytes, 16 bytes of which are used for error correction encoding. FEC decoder 321 generates a one bit "block error" signal indicating whether the number of errors in a given block is above or below a threshold and thereby whether or not error correction is possible. The "block error" signal has first logic state, for example, a "0", when error correction is possible and a second logic state, for example, a "1", error correction is not possible. The "block error" signal may change with each block of digital data.

The manner in which microprocessor 337 responds to the "demodulator lock" and "block error" signals during the antenna alignment mode of operation will now be described. Reference to the flow chart shown in FIG. 2, which represents the antenna alignment subroutine stored within a memory section of microprocessor 337, will again be helpful. After the antenna alignment mode of operation is initiated and a predetermined carrier frequency is selected for tuning, microprocessor 337 monitors the state of the "demodulator lock" signal. If the "demodulator lock" signal has a logic "0" state, indicating that demodulation cannot be achieved at the current search frequency, microprocessor 337 either causes the next search frequency to be selected, or if all the search frequencies have already been searched, causes the tone burst or beep to be generated. If the "demodulator lock" signal has the logic "1" state, indicating that demodulator 319 has successfully completed its demodulation operation, the "block error" signal is examined to determine whether error correction is possible or not.

The error condition at the low data rate is examined first. If error correction is not possible at the low data rate, the error condition at the high data rate is examined. For each data rate, microprocessor 337 repetitively samples the "block error" signal because the "block error" signal may change with each block of digital data. If the "block error" signal has the logic "1" state for a given number of samples for both data rates, indicating that error correction is not possible, microprocessor 337 either causes the next search frequency to be selected, or if all the search frequencies have been searched, causes the tone burst or beep to be generated. On the other hand, if the "block error" signal has the logic "0" state for the given number of samples, indicating that error correction is possible, microprocessor 339 causes the continuous tone to be generated.

The audible tone burst and continuous tone may be generated by dedicated circuitry, for example, including an oscillator coupled to the output of audio DAC 327. However, such dedicated circuitry would add to the complexity and therefore cost of satellite receiver 17. To avoid such complexity and added cost, the embodiment shown in FIG. 3 makes advantageous dual use of structure that is already present. The manner in which the audible tones are generated in the embodiment shown in FIG. 3 will now be described.

ROM 339 stores digital data encoded to represent an audible tone at a particular memory location. Desirably, the tone data is stored as a packet in the same compressed form, for example, according to the MPEG audio standard, as the transmitted audio packets. To produce the continuous audible tone, microprocessor 337 causes the tone data packet to read from the tone data memory location of ROM 339 and to be transferred to an audio data memory location of a random access memory (RAM, not shown) associated with transport 323. The RAM is normally used to temporarily store packets of the data stream of the transmitted signal in respective memory locations in accordance with the type of information which they represent. The audio memory location of the transport RAM in which the tone data packet is stored is the same memory location in which transmitted audio packets are stored. During this process, microprocessor 337 causes the transmitted audio data packets to be discarded by not directing them to the audio memory location of the RAM.

The tone data packet stored in the RAM is transferred via the data bus to audio decoder 327 in the same manner as the transmitted audio data packets. The tone data packet is decompressed by audio decoder 327 in the same manner as any transmitted audio data packet. The resultant decompressed digital audio signal is converted to an analog signal by DAC 331. The analog signal is coupled to speakers **23*a* and 23*b*** which produce the continuous audible tone.

To generate a tone burst or beep, microprocessor 337 causes the tone data packet to be transferred to audio decoder 327 in the same manner as described above, but causes the audio response to be muted except for a short time by causing a muting control signal to be coupled to audio decoder 327.

The above described process for generating the audible tone and tone bursts can be initiated at the beginning of the antenna alignment operation. In that case, microprocessor 337 generates a continuous muting control signal until either the generation of the continuous tone or tone burst is required.

The tone burst and continuous tone may alternatively be generated in the following way. To produce the tone burst, microprocessor 337 causes the tone data packet to read from the tone data memory location of ROM 339 and to be transferred to decoder 327 via transport 322 in the manner described above. To generate a continuous tone, microprocessor 337 cyclically causes the tone data packet to read from the tone data memory location of ROM 339 and to be transferred to decoder 327. In essence, this produces an almost continuous series of closely spaced the tone bursts.

As earlier mentioned, demodulator 319 generates a "signal quality" signal which is indicative of the signal-to-noise ratio (SNR) of the received signal. The SNR signal has the form of digital data and is coupled to microprocessor 337 which converts it to graphics control signals suitable for displaying a signal quality graphics on screen 21 of television receiver 19. The graphics control signals are coupled to an on-screen display (OSD) unit 341 which causes graphics representative video signals to be coupled to television receiver 19. The signal quality graphics may take the form of a triangle which increases in the horizontal direction as the signal quality improves. The graphics may also take the form of a number which increases as the signal quality improves. The signal quality graphics may assist the user in optimizing the adjustment of either or both of the elevation and azimuth positions. The signal quality graphics feature may be selected by a user by means of the antenna alignment menu referred to earlier.

The apparatus and method utilizing the error condition of the received signal in accordance with the invention which have been described so far are for manually aligning antenna 7. However, the error condition may also be utilized in accordance with another aspect of the invention in an apparatus and a method for automatically aligning antenna 7. Such automatic antenna alignment apparatus and method may eliminate the need for manual alignment, and is particularly useful when satellite receiver 17 is intended to receive signals from several different satellites.

Figure 4:
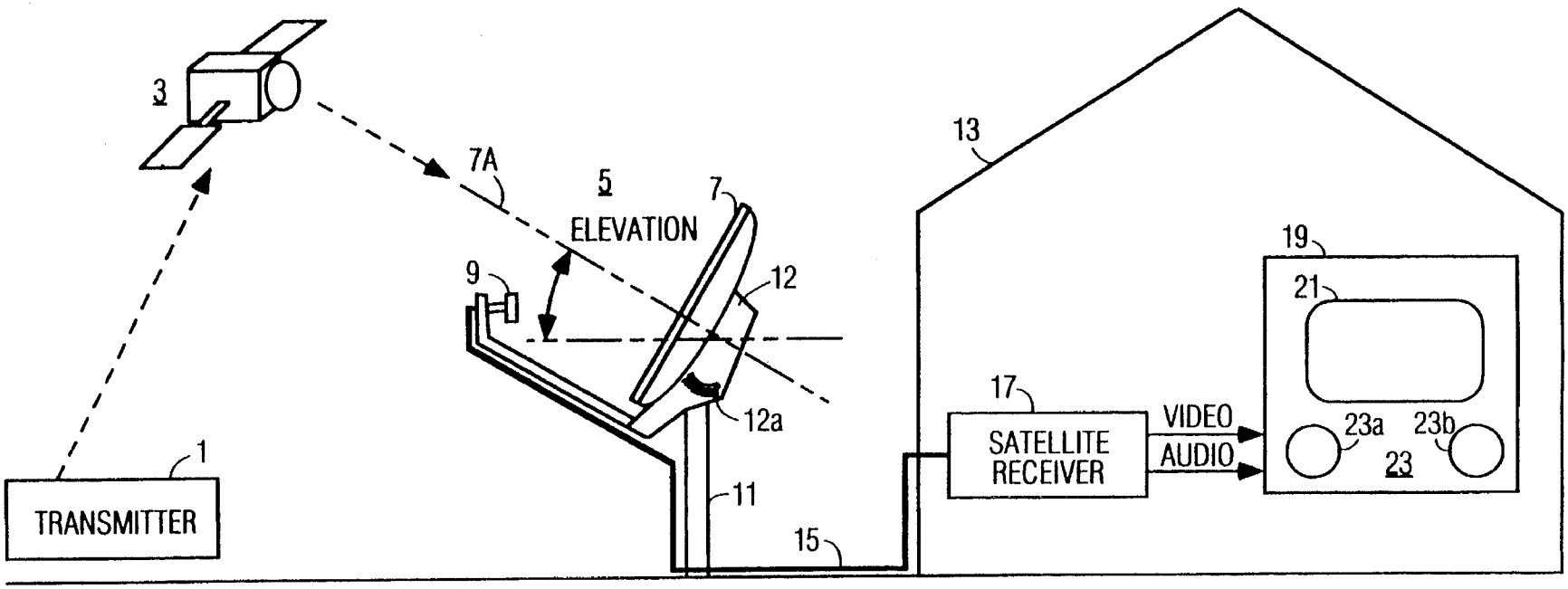
FIG. 4 is a schematic diagram of the mechanical arrangement of a satellite television receiving system similar to the one shown in FIG. 1 except that a motor has been added for the automatic alignment of the antenna assembly.
Figure 5:
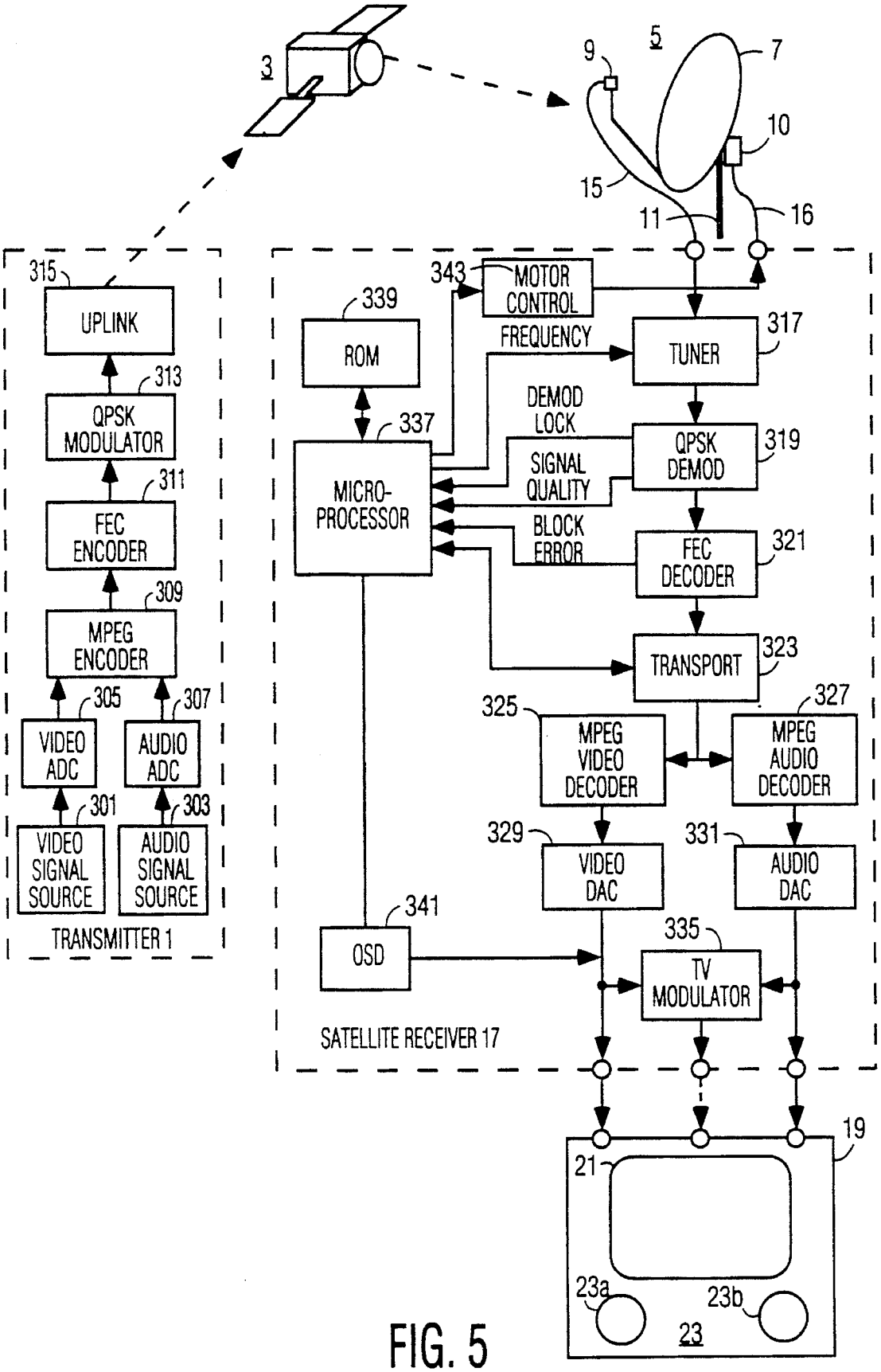
FIG. 5 is a block diagram of the electronic components of the satellite television system shown in FIG. 4 useful in understanding an apparatus for automatically aligning the antenna assembly shown in FIG. 4 in accordance with the present invention.
Figure 6:
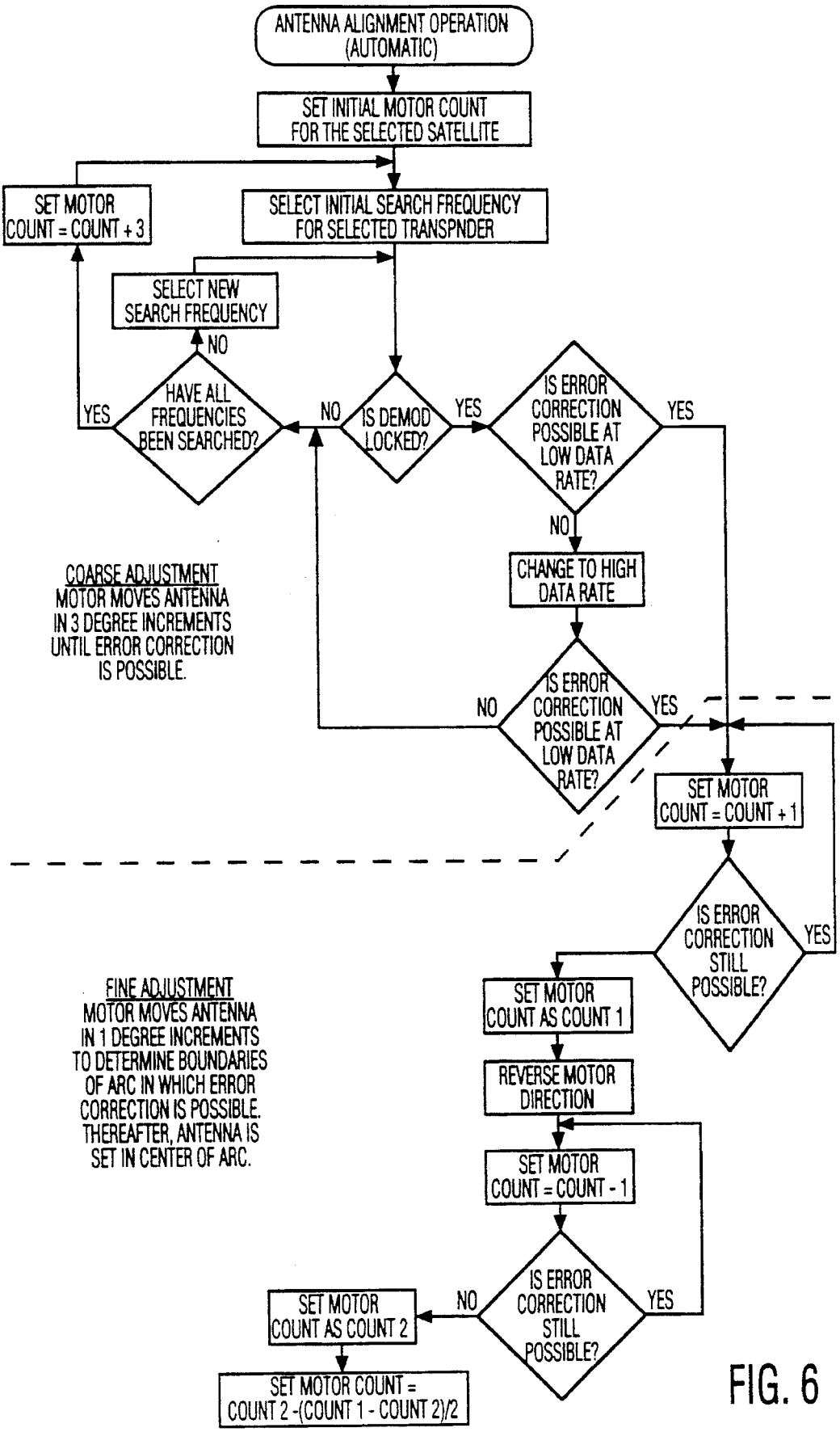
FIG. 6 is a flow chart useful in understanding both the apparatus for automatically aligning the antenna assembly shown in FIGS. 4 and 5 an the method under which it operates in accordance with respective aspects of the present invention.

The automatic antenna alignment apparatus and method will be described with respect to FIGS. 4, 5, and 6. FIGS. 4, 5 and 6 are generally similar to FIGS. 1, 2 and 3, respectively, except that modifications concerned with the automatic alignment apparatus and method have been made. The plan view shown in FIG. 1 a of antenna assembly 5 shown in FIG. 1 is equally applicable to antenna assembly 5 shown in FIG. 4.

As shown in FIG. 4, a motor 10 is coupled between mounting fixture 12 and pole 11 for rotating antenna assembly 5 around pole 11 so as to adjust the azimuth position of antenna assembly 5. A control cable 16 is connected between motor 10 and satellite receiver 17.

As shown in FIG. 5, motor control cable 16 is coupled to a motor controller 343 included within satellite receiver 17. Motor controller 343 receives motor control signals from microprocessor 337 to control the azimuth position of antenna 10. Motor 10 desirably is a step motor, and each step of motor 7 may, for example, correspond to one degree of rotation of antenna 7. Microprocessor 337 includes a register (not shown) for storing a count corresponding to the step position of motor 10. This count will be referred to as the "motor count" in the following description of the automatic alignment operation.

The automatic antenna alignment operation is initiated, for example, manually by the user at the time of installation or automatically when a new satellite is selected. The elevation of antenna 7 is set before the azimuth. Although not shown, another motor and associated motor control unit are provided to automatically set the elevation of antenna 7. An elevation look up table stored in ROM 339 contains control information for the elevation motor in accordance with the selected satellite and the latitude of the receiving location. The elevation motor control information is read by microprocessor 337 and coupled to the elevation motor control unit in order to set the elevation of antenna 7.

Thereafter, as shown in FIG. 6, the automatic antenna azimuth alignment operation starts with setting an initial "motor count" for the selected satellite. The initial "motor count" is dependent on the selected satellite and the longitude of the receiving site and is contained in an azimuth look up table stored in ROM 339. Thereafter, a course alignment mode of operation is initiated by initiating a similar tuner search algorithm for finding an appropriate tuning frequency at which demodulation is possible as was previously described with respect to the flow chart shown in FIG. 2 in connection with the manual antenna alignment procedure. If the "demodulator lock" signal has a logic "0" state, indicating that demodulation cannot be achieved at the present search frequency, microprocessor 337 either causes the next search frequency to be selected, or if all the search frequencies have already been searched, causes motor 10 to move antenna 7 in a small increment, for example three degrees, by setting the "motor count" accordingly. If the "demodulator lock" signal has the logic "1" state, indicating that demodulator 319 has successfully completed its demodulation operation, the "block error" signal is examined to determine whether error correction is possible or not.

Figure 2:
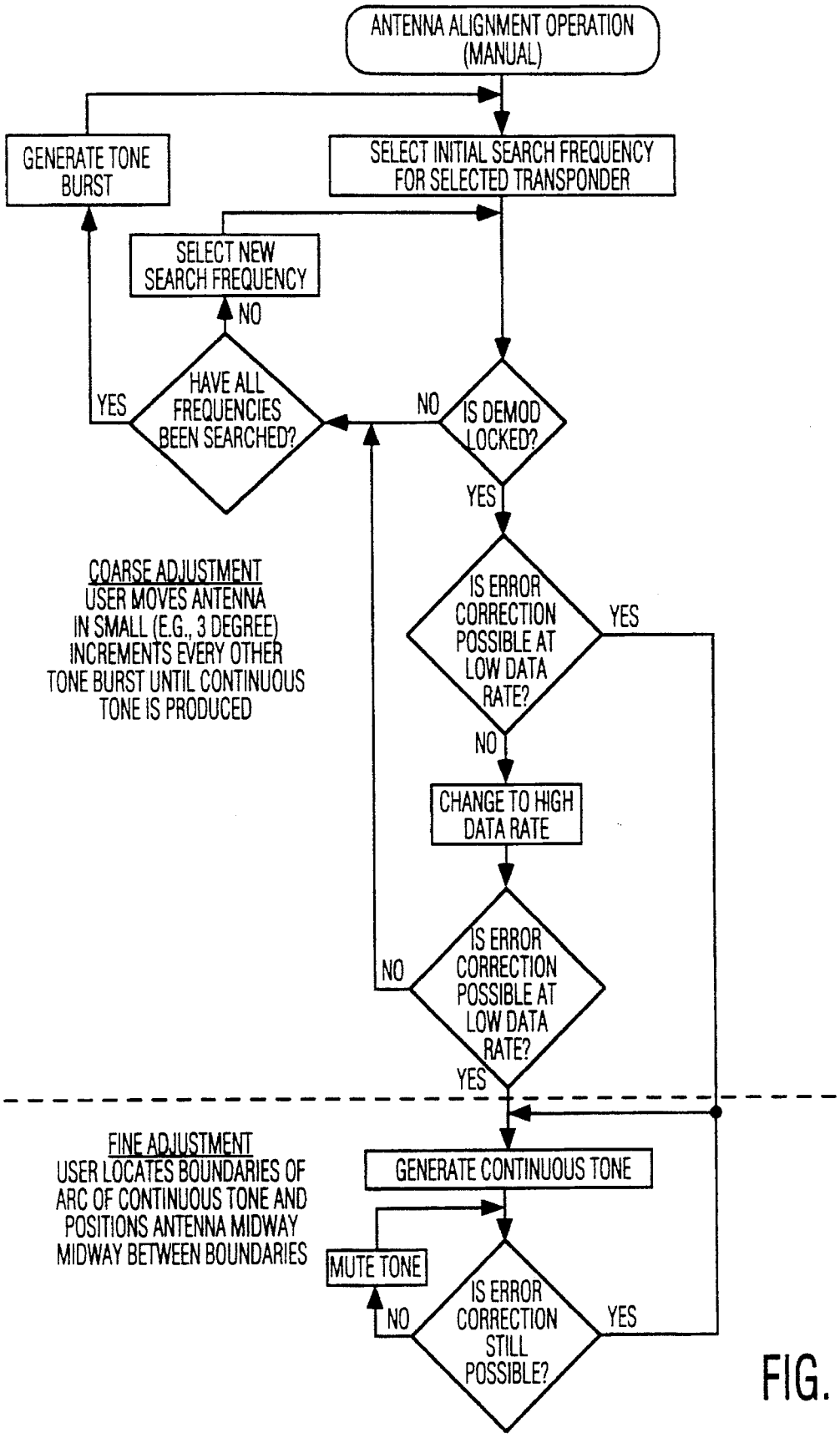
FIG. 2 is a flow chart useful in understanding both a method and an apparatus for manually aligning the antenna assembly shown in FIGS. 1 and 1*a* in accordance with respective aspects of the present invention.

The error condition is examined in the same manner as described with respect to the flow chart of FIG. 2 by sampling the "block error" signal. If the "block error" signal has the logic "1" state for a given number of samples for both data rates, indicating that error correction is not possible, microprocessor 337 either causes the next search frequency to be selected, or if all the search frequencies have been searched, causes motor 10 to move antenna in the small increment, for example three degrees, by setting the "motor count" accordingly. On the other hand, if the "block error" signal has the logic "0" state for the given number of samples, indicating that error correction is possible, microprocessor 337 causes a fine adjustment mode of operation to be initiated.

During the fine adjustment mode of operation, antenna 7 is causes to be moved in very small increments, for example, one degree increments, by setting the "motor count" accordingly in order to locate the arc in which error correction is possible. As is shown in FIG. 6, the "motor count" is increased by one count until error correction is no longer possible. The "motor count" value at that point is stored as "count 1" and the direction of motor rotation is reversed. The "count 1" value corresponds to a first boundary of the arc in which error correction is possible, and reversing the direction of rotation causes antenna 7 to be positioned so that error correction is possible once again. Thereafter, the "motor count is decreased by a count of one until error correction is again no longer possible. The "motor count" value at that point is stored as "count 2". The "count 2" value corresponds to the second boundary of the arc in which error correction is possible. Thereafter, the difference between the "count 1" and "count 2" values is calculated, the difference is halved, and the result is added to the "count 2" value (or in the alternative is subtracted from the "count 1" value) to produce a final "motor count" value. This causes antenna to be set midway between the two boundaries of the arc in which error correction is possible.

While the invention has been described with reference to a specific method and apparatus, it will be appreciated that improvements and modifications will occur to those skilled in the art. For example, while the a continuous tone and an intermittent tone respectively corresponding to proper and improper alignment are used in the described manual method and apparatus, two other audible responses, such as tones of two different frequencies or two different magnitudes, may also be utilized to signify those conditions. In addition, while the invention has been described with respect to the adjustment of the azimuth position of an antenna, it will be appreciated that it is also applicable to other orientations of the antenna. These and other modifications are intended to be included within the scope of the invention defined by the following claims.

We claim:

1. A method of aligning an antenna which receives a signal having a component which is encoded in digital form, said received signal being coupled to a receiver including means for detecting a digital error condition of said digital component, and means for generating a digital error condition indicating signal having a first state when said digital error condition exceeds a threshold indicating that digital error correction is not possible and having a second state when said digital error condition is below said threshold indicating that digital error correction is possible, comprising the steps of:

moving said antenna from an initial position;

noting a first position at which said digital error condition indicating signal changes from said first state to said second state and noting a second position at which said digital error condition indicating signal changes from said second state to said first state as said antenna is moved to determine the boundaries of a region of antenna positions in which digital error correction is possible; and determining from said first and second noted positions a position substantially midway between said first and second positions within said region in which digital error correction is possible; and moving said antenna to said midway position.

2. The method recited in claim 1, wherein:

said antenna is manually moved; and said step for determining said first and second positions includes manually monitoring an antenna alignment response caused to be generated by said receiver in response to said digital error condition indicating signal and having first and second characteristics corresponding to said first and second states of said digital error condition indicating signal.

3. The method recited in claim 1, wherein said antenna is a satellite receiving antenna and said receiver is a satellite receiver, and wherein:

the azimuth position is aligned according to the method recited in claim 1.

4. The method recited in claim 3, wherein:

the elevation position of said antenna is set before said azimuth position is aligned.

5. In a receiver which receives a signal having an information bearing component encoded in digital form from an antenna, apparatus for aligning said antenna comprising:

means for detecting a digital error condition of said digitally encoded information component and generating a signal indicating whether or not digital error correction is possible; and means responsive to transitions of said digital error correction indicating signal for determining the boundaries of a region of antenna positions in which digital error correction is possible.

6. The apparatus recited in claim 5, wherein:

said means for determining said region of antenna positions in which digital error correction is possible generates a signal for producing a response for indicating said region to a user.

7. The apparatus recited in claim 5, wherein:

a tuner/demodulator derives said information component from said received signal and generates a signal indicating the completion of its operation;

said means for determining said region of antenna positions in which digital error correction is possible includes a controller which also controls the operation of said tuner/demodulator for selectively causing said tuner/demodulator to search a given range of search frequencies to find an appropriate frequency for tuning a signal received by said receiver; said controller causing said tuner/demodulator to search said given range of search frequencies again after said search range has been completely searched in a previous search if an appropriate frequency for tuning said received signal has been not found or if digital error was not possible for any of said search frequencies.

* * * * *